US009321257B2

(12) United States Patent
Miller et al.

(10) Patent No.: US 9,321,257 B2
(45) Date of Patent: Apr. 26, 2016

(54) CYLINDER WITH RECESSED PORTIONS FOR HOLDING TUBULAR ARTICLES FOR PRINTING

(71) Applicant: NIKE, Inc., Beaverton, OR (US)

(72) Inventors: Todd W. Miller, Portland, OR (US); Catherine F. Morrison, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/242,695

(22) Filed: Apr. 1, 2014

(65) Prior Publication Data

US 2014/0299009 A1 Oct. 9, 2014

Related U.S. Application Data

(60) Provisional application No. 61/808,559, filed on Apr. 4, 2013.

(51) Int. Cl.

| | |
|---|---|
| ***B41F 17/08*** | (2006.01) |
| ***B41F 17/00*** | (2006.01) |
| ***B41J 3/407*** | (2006.01) |
| ***B41J 11/04*** | (2006.01) |
| *B41M 1/40* | (2006.01) |
| *B41F 17/38* | (2006.01) |
| *B41F 17/18* | (2006.01) |

(52) U.S. Cl.

CPC ..... *B41F 17/005* (2013.01); *B41J 3/4078* (2013.01); *B41J 11/04* (2013.01); *B41F 17/08* (2013.01); *B41F 17/18* (2013.01); *B41F 17/38* (2013.01); *B41M 1/40* (2013.01)

(58) Field of Classification Search

CPC ..... B41F 17/002

See application file for complete search history.

(56) References Cited

U.S. PATENT DOCUMENTS

| | | | | | |
|---|---|---|---|---|---|
| 701,841 | A | | 6/1902 | Chandler | |
| 1,830,638 | A | | 11/1931 | Butz | |
| 2,249,939 | A | * | 7/1941 | Branan | 101/38.1 |
| 2,459,538 | A | * | 1/1949 | Robbins | 101/38.1 |
| 2,920,556 | A | * | 1/1960 | Medert et al. | 101/38.1 |
| 2,974,838 | A | | 3/1961 | Parham | |

(Continued)

FOREIGN PATENT DOCUMENTS

| | | | | |
|---|---|---|---|---|
| CN | 201703004 | U | | 1/2011 |
| GB | 736550 | A | * | 3/1954 |
| GB | 2291011 | | | 1/1996 |

OTHER PUBLICATIONS

International Search Report and Written Opinion mailed Sep. 1, 2014 in PCT/US2014/032798.

(Continued)

*Primary Examiner* — Jill Culler

(74) *Attorney, Agent, or Firm* — Plumsea Law Group, LLC

(57) ABSTRACT

A customization system for a tubular article of apparel includes a printing system for printing a graphic onto the tubular article. The customization system also includes a cylinder for holding the tubular article for printing a graphic upon the article. The cylinder can include one or more recesses in the outer surface of the cylinder to accommodate one or more regions of increased thickness on the tubular article. By providing recesses in the cylinder that correspond to the regions of increased thickness, the tubular article can present a substantially uniform flat surface for printing the graphic upon.

20 Claims, 7 Drawing Sheets

(56) References Cited

U.S. PATENT DOCUMENTS

| | | | | |
|---|---|---|---|---|
| 3,794,314 | A | 2/1974 | Coburn et al. | |
| 4,303,459 | A | 12/1981 | Kleber | |
| 4,561,642 | A | 12/1985 | Parque | |
| 4,590,854 | A | 5/1986 | Anderson | |
| 4,619,384 | A | 10/1986 | Chu et al. | |
| 4,846,483 | A | 7/1989 | Sorensen | |
| 4,930,413 | A | 6/1990 | Jaffa | |
| 5,288,322 | A * | 2/1994 | Hanna et al. | 101/35 |
| 5,831,641 | A | 11/1998 | Carlson | |
| 5,906,363 | A | 5/1999 | Reis et al. | |
| 6,014,162 | A | 1/2000 | Kerr et al. | |
| 6,254,081 | B1 | 7/2001 | Rasmussen et al. | |
| 6,267,054 | B1 | 7/2001 | Lopes | |
| 6,481,347 | B2 | 11/2002 | Ackley | |
| 6,729,235 | B2 | 5/2004 | Kerr | |
| 7,114,445 | B2 | 10/2006 | Ackley et al. | |
| 7,311,045 | B2 | 12/2007 | Ackley, Jr. et al. | |
| 7,946,668 | B2 | 5/2011 | Baker et al. | |
| 2008/0229943 | A1 | 9/2008 | Barinaga et al. | |
| 2011/0036252 | A1 | 2/2011 | Middo | |
| 2013/0057632 | A1 | 3/2013 | Moriya et al. | |
| 2013/0340484 | A1 * | 12/2013 | Turner | 347/104 |
| 2014/0300676 | A1 * | 10/2014 | Miller et al. | 347/110 |

OTHER PUBLICATIONS

International Search Report and Written Opinion mailed Sep. 1, 2014 in PCT/US2014/032677.

International Preliminary Report on Patentability and Written Opinion of the International Searching Authority issued Oct. 15, 2015 in International Patent Application No. PCT/US2014/032798.

International Preliminary Report on Patentability and Written Opinion of the International Searching Authority issued Oct. 6, 2015 in International Patent Application No. PCT/US2014/032677.

* cited by examiner

CYLINDER WITH RECESSED PORTIONS FOR HOLDING TUBULAR ARTICLES FOR PRINTING

CROSS-REFERENCE TO RELATED APPLICATION

This application claims priority under 35 U.S.C. §119(e) to U.S. Provisional Patent Application No. 61/808,559, entitled "Cylinder with Recessed Portions for Holding Tubular Articles for Printing", and filed on Apr. 4, 2013, which application is hereby incorporated by reference.

BACKGROUND

The present invention relates generally to articles of clothing and in particular to a customization system for printing onto tubular articles.

Systems for printing onto three dimensional articles are known in the art. U.S. Pat. No. 5,831,641 to Carlson discloses methods and an apparatus for imprinting indicia on a three dimensional article using an ink jet image transfer technique. Carlson uses an article positioning apparatus that maintains the surface of the three dimensional article to be printed within a plane substantially parallel and spaced apart from the plane of the ink jet nozzles. Carlson discloses printing onto a baseball bat, which is typically a rigid article having a relatively uniform smooth surface for printing.

Therefore, there exists a need in the art for an apparatus for holding non-rigid articles, including articles of clothing and tubular articles, to provide a substantially uniform flat surface for printing.

SUMMARY

A customization system for printing graphics onto articles of apparel includes a cylinder and a printer. The article of apparel is associated with the cylinder, which provides a rigid mounting surface for the article of apparel. The cylinder is positioned proximate the printer so that the article of apparel can be the print surface, i.e., the printer prints onto the article of apparel. The cylinder may be provided with a recess or recesses to accommodate varying thicknesses of the article of apparel, such as variations in the thickness of the weave, padding, and/or other components or elements. The thicker portions of the article of apparel can extend into the recess or recesses so that the outermost surface of the article of apparel on the cylinder is substantially flat to assist in printing an error-free graphic. The cylinder can be rotated so that any portion of the tubular article may be printed, including a graphic of any angle up to or in excess of 360 degrees.

In one aspect, the invention provides a customization system for printing a graphic onto a tubular article of apparel, comprising: a printing system, including a printer; a cylinder for holding the tubular article in proximity to the printer; wherein the tubular article is disposed over an outer surface of the cylinder; and wherein the cylinder is configured to rotate relative to the printer to allow the printer to print a graphic onto the tubular article.

In another aspect, the invention provides a cylinder for holding a tubular article of apparel to assist with printing a graphic onto the tubular article, comprising: an outer surface of the cylinder, the outer surface having a length along a longitudinal direction of the cylinder and the cylinder having a diameter; the length and the diameter of the cylinder sized and dimensioned so as to correspond to a length and diameter of the tubular article of apparel; and wherein the cylinder is configured to rotate to expose an exterior surface of the tubular article to a printer for printing.

In another aspect, the invention provides a cylinder for holding a tubular article of apparel to assist with printing a graphic onto the tubular article, comprising: a diameter associated with the cylinder and a length along a longitudinal direction of the cylinder; an outer surface disposed over the length of the cylinder; the outer surface including at least one recess, the at least one recess extending a depth below the outer surface; wherein the tubular article of apparel is configured to be disposed over the outer surface of the cylinder; and wherein at least one region of increased thickness disposed on the tubular article is configured to correspond with the at least one recess disposed in the outer surface of the cylinder.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
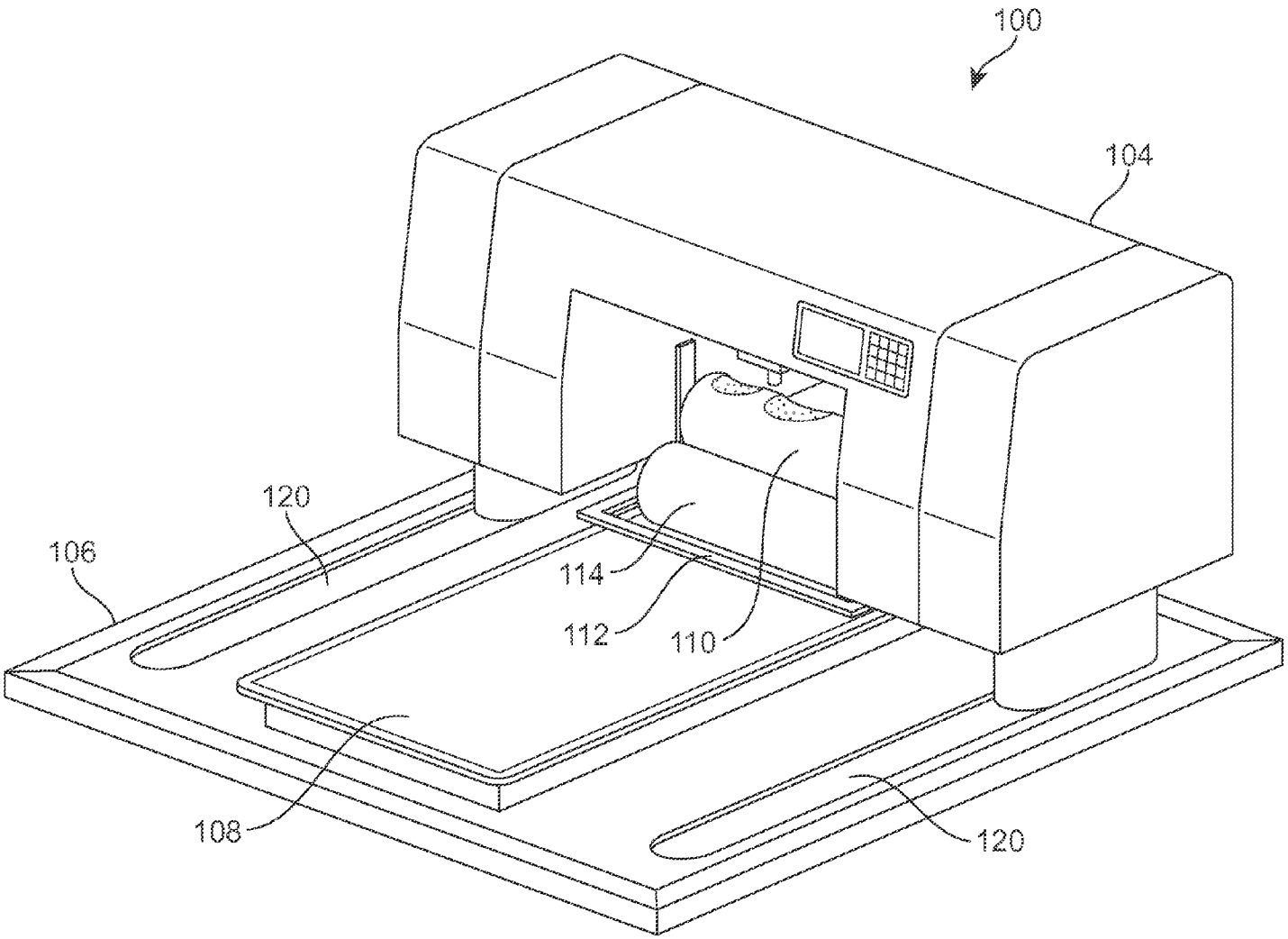
FIG. 1 is a schematic view of an exemplary embodiment of a customization system for a tubular article.

FIG. 1 is a schematic view of an embodiment of customization system 100. In some embodiments, customization system 100 may be intended for use with various kinds of articles including apparel and/or footwear. In particular, customization system 100 may include various kinds of provisions for applying graphics, or any type of design or image, to apparel and/or footwear. Moreover, the process of applying graphics may occur after an article has been manufactured. For example, graphics may be applied to an article of clothing after the article of clothing has been manufactured into a three-dimensional form. In other cases, graphics may be applied to an article of clothing, or one or more components of an article of clothing, prior to, and/or during, manufacture. For example, graphics may be applied to a sleeve of a coat or jacket prior to being assembled into a finished article.

The term "graphic" as used throughout this detailed description and in the claims refers to any visual design elements including, but not limited to: photos, logos, text, illustrations, lines, shapes, images of various kinds as well as any combinations of these elements. Moreover, the term graphic is not intended to be limiting and could incorporate any number of contiguous or non-contiguous visual features. For example, in one embodiment, a graphic may comprise a logo that is applied to a small region of an article of footwear. In another embodiment, a graphic may comprise a large region of color that is applied over one or more regions of an article of clothing.

For clarity, the following detailed description discusses an exemplary embodiment, in which customization system 100 is used to apply graphics to an article of clothing. In this case, the article of clothing, or simply article, may take the form of a cylindrical or tubular article, such as an athletic sock. However, it should be noted that the other embodiments could be used with any other kinds of cylindrical or tubular apparel and/or articles of clothing including, but not limited to: socks, leg sleeves, arm sleeves, armbands, wristbands, headbands, as well as individual components of apparel and/or clothing, including, but not limited to sleeves for shirts, coats, jackets, and/or sweaters, and legs for pants, shorts, and/or leggings. While FIG. 1 shows a single article, it will be understood that customization system 100 could be used to apply graphics to two or more articles.

Customization system 100 need not be limited to use with articles of clothing and the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, as well as other articles. Other examples of articles include, but are not limited to: shin guards, knee pads, elbow pads, shoulder pads, as well as any other type of protective equipment. Additionally, in some embodiments, the article could be another type of article that is not configured to be worn, including, but not limited to: balls, bags, purses, backpacks, as well as other articles that may not be worn.

Customization system 100 may comprise various provisions that are useful in applying a graphic directly to an article. In some embodiments, customization system 100 may include printing system 104. Printing system 104 may comprise one or more individual printers. Although a single printer is illustrated in FIG. 1, other embodiments could incorporate two or more printers that may be networked together.

Printing system 104 may utilize various types of printing techniques. These may include, but are not limited to: toner-based printing, liquid inkjet printing, solid ink printing, dye-sublimation printing, inkless printing (including thermal printing and UV printing) as well as any other methods of printing. In some cases, printing system 104 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In one embodiment, printing system 104 may utilize an inkjet printer in which ink droplets may be sprayed onto a substrate, such as the outer surface of an article of clothing. Using an inkjet printer allows for easy variation in color and ink density. This arrangement also allows for some separation between the printer head and the target object, which can facilitate printing directly to objects with some curvature and/or surface texture.

In some embodiments, customization system 100 may include additional components for mounting various portions of customization system 100. In an exemplary embodiment, customization system 100 may include a base portion 106. Base portion 106 may comprise a substantially flat surface for mounting one or more components of customization system 100. In an exemplary embodiment, printing system 104 may be disposed on a top side of base portion 106. In some embodiments, base portion 106 may include a stationary platform 108 that comprises a surface for receiving one or more articles. In an exemplary embodiment, stationary platform 108 may be configured to raise an object or an article above the surface of base portion 106. In some cases, stationary platform 108 may be fixed approximately in place on base portion 106. In other cases, stationary platform 108 may be instead be replaced by a movable platform that is configured to move relative to base portion 106. For example, a movable platform may be provided with a tracked or wheeled arrangement as is known in the art to provide movement relative to base portion 106.

In some embodiments, customization system 100 may include a printing system 104 that is configured to move to various positions. In an exemplary embodiment, printing system 104 may be mounted to tracks 120 of base portion 106. In some cases, printing system 104 is mounted in a movable manner to base portion 106, so that printing system 104 may slide or travel along tracks 120. This allows printing system 104 to move between various positions along base portion 106 in the direction of tracks 120 and relative to stationary platform 108. In other cases, printing system 104 may be configured to be stationary on base portion 106 and a movable platform, as discussed above, may be used to move an object or article relative to printing system 104. In still other cases, printing system 104 and a movable platform may be used in combination with one another.

In some embodiments, customization system 100 may be configured to print onto articles of clothing, including, but not limited, to various types of apparel. In an exemplary embodiment, customization system 100 may be configured to print onto articles of clothing or apparel that have a cylindrical, circular, round, or generally tubular configuration including, but not limited to: socks, leg sleeves, arm sleeves, armbands, wristbands, headbands, as well as individual components of apparel and/or clothing, including, but not limited to sleeves for shirts, coats, jackets, and/or sweaters, and legs for pants, shorts, and/or leggings.

In contrast to flat articles or generally rigid articles, articles of clothing or apparel having a generally tubular or cylindrical configuration may pose challenges for presenting a substantially uniform flat surface for printing. Typically, a tubular or cylindrical article may be worn on a portion of a wearer's body that provides support to hold the shape of the article. When removed from the wearer's body, the article may then be in a flat or unsupported configuration. Accordingly, in an exemplary embodiment, customization system 100 may be provided with an apparatus for holding a tubular article to provide a substantially uniform flat surface for printing. In one embodiment, the apparatus for holding the tubular article may be configured as a cylinder 110.

In some embodiments, cylinder 110 may be provided with customization system 100 to hold a cylindrical or tubular article of clothing or apparel in a supported configuration. In the supported configuration, printing system 104 may have a substantially uniform flat surface for printing onto the tubular article disposed on cylinder 110. With this arrangement, the tubular article may have a graphic printed upon it while in a similar configuration as the article is intended to be worn. Accordingly, when the printed article is placed upon the wearer's body, the graphic should appear relatively undistorted from the manner in which it was printed.

In some embodiments, customization system 100 may be provided with an apparatus configured to circumferentially rotate cylinder 110. In an exemplary embodiment, customization system 100 may include a carrier 112 that is attached to printing system 104 and is configured to circumferentially rotate cylinder 110. Carrier 112 may be a rigid structure or device that is mounted under printing system 104 and that includes at least two rollers 114 that are in contact with stationary platform 108. In one embodiment, cylinder 110 may rest on top of rollers 114 above carrier 112. In cases where printing system 104 is configured to move while stationary platform 108 remains in place, carrier 112 translates the linear movement of printing system 104 along tracks 120 into rotational movement of cylinder 110. Rollers 114 in contact with stationary platform 108 rotate when printing system 104 moves along tracks 120. The rotation of rollers 114 is then transferred to cylinder 110, which is in contact with rollers 114 above carrier 112. With this arrangement, cylinder 110 may be circumferentially rotated to allow for printing over the exterior surface of an article when disposed on cylinder 110.

In other embodiments, a different arrangement may be provided to rotate cylinder 110. For example, in some cases, cylinder 110 may be rotated using a rack and pinion arrangement to translate the linear motion of printing system 104 and/or a movable platform into rotational motion of cylinder 110. In still other cases, other arrangements may be used to impart rotational motion to cylinder 110. For example, in another case, cylinder 110 may be rotated using an actuator motor that turns a gear or chain drive to rotate cylinder 110. In addition, various other devices may be used as is known in the art to rotate cylinder 110.

In some embodiments, cylinder 110 may be configured to receive articles of clothing or apparel that have non-uniform thicknesses throughout the article. In some cases, an article may include regions associated with a greater amount of thickness than other regions. For example, an article may include a thicker woven material, padding, and/or other elements that may cause the article to be thicker in some portions than in others. Such an article having a non-uniform thickness may not present a substantially uniform flat surface for printing when disposed on a cylinder. In some embodiments, cylinder 110 may include one or more depressions or recesses in the outer surface of cylinder 110 to accommodate regions of varying thickness in an article.

Figure 2:
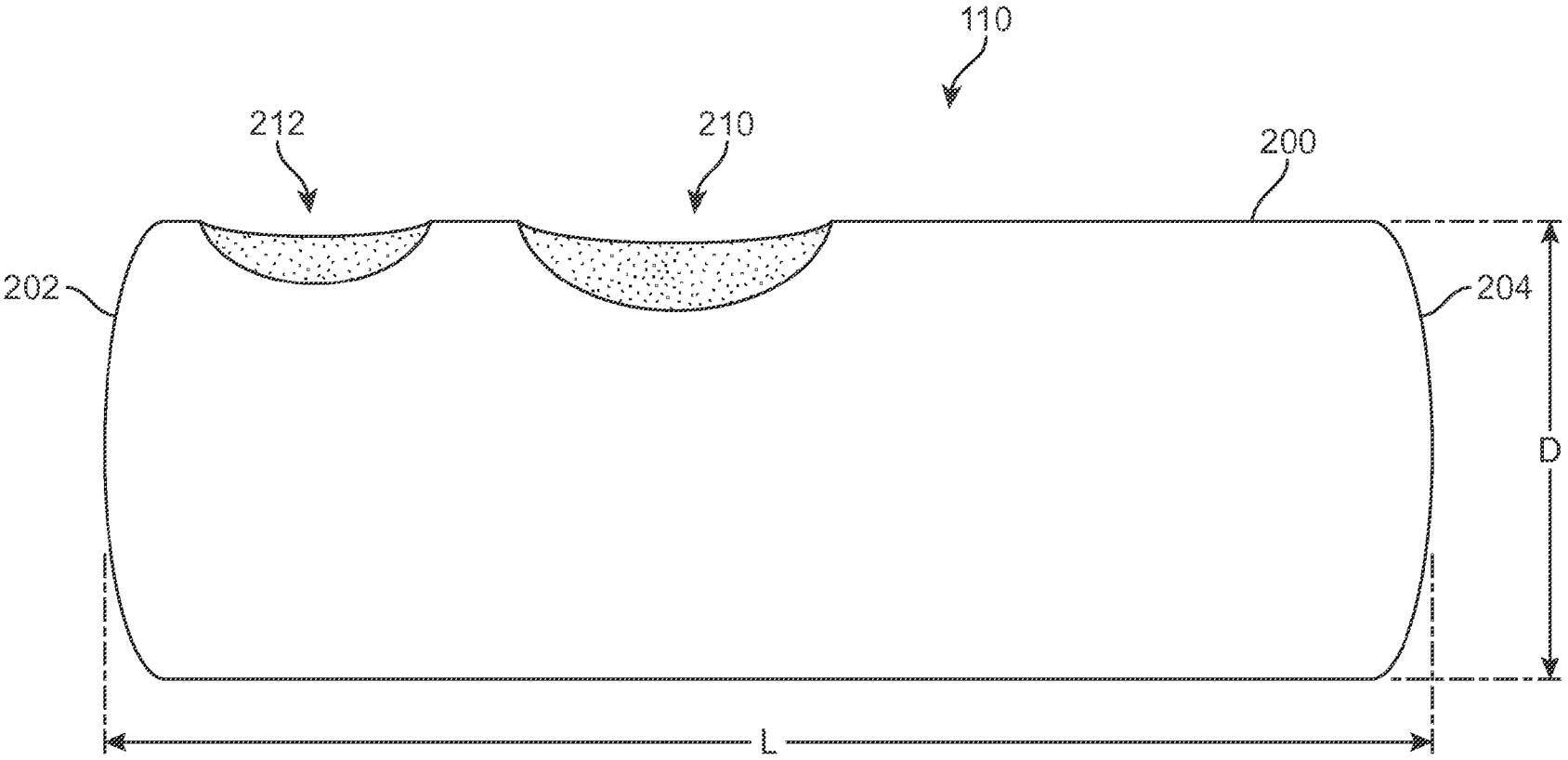
FIG. 2 is an isometric view of an exemplary embodiment of a cylinder for holding tubular articles for use with a customization system.

Referring now to FIG. 2, an exemplary embodiment of cylinder 110 including one or more depressions or recesses in the outer surface of cylinder 110 to accommodate regions of varying thickness in an article is illustrated. In an exemplary embodiment, cylinder 110 may be a right circular cylinder associated with a length L along a longitudinal direction of cylinder 110 and a diameter D between opposing points along a circular cross-section of cylinder 110. In this embodiment, cylinder 110 has an outer surface 200 disposed over the exterior of cylinder 110. The surface area of outer surface 200 of cylinder 110 may be determined from a known geometric formula for determining the surface area of a right circular cylinder ($A=2\pi rh$). In this embodiment, the surface area of cylinder 110 is equal to $D\pi rL$.

In other embodiments, different cylinders may be provided with different dimensions, including a larger or smaller diameter and/or a larger or smaller longitudinal length L, than cylinder 110. In some embodiments, various cylinders may be provided that are sized and dimensioned so as to support different articles of clothing or apparel. For example, a cylinder having a larger diameter and/or a larger length that may be provided for supporting an arm or leg sleeve or a coat sleeve or leg for a pair of pants for printing. In another example, a cylinder having a smaller diameter and/or a smaller length that may be provided for supporting an armband, headband, or wristband for printing. In another example, a cylinder may have sufficient length so that two articles may be positioned adjacent each other length-wise along the cylinder for simultaneous printing. It should be understood that a cylinder of any diameter and/or length may be provided to fit a specific article of clothing or apparel for printing.

In some embodiments, cylinder 110 may be described as having a first end 202 and a second end 204 disposed opposite first end 202. First end 202 and second end 204 may be used for purposes of reference to describe the relative location of an article disposed on cylinder 110. In an exemplary embodiment, cylinder 110 may be provided with one or more depressions or recesses in outer surface 200, including a first recess 210 and a second recess 212. Each of first recess 210 and second recess 212 may be configured to accommodate and correspond with regions of an article that have a thickness that is greater than the remaining portions of the article.

In this embodiment, first recess 210 may be disposed on outer surface 200 towards first end 202 and second recess 212 may be disposed on outer surface 200 adjacent to first end 202 and between first end 202 and first recess 210. In other embodiments, one or more recesses, including first recess 210 and/or second recess 212 may be disposed on outer surface 200 of cylinder 110 at different locations to correspond to the locations of greater thickness on an article that is to be placed upon cylinder 110.

In different embodiments, the recesses or depressions in outer surface 200 of cylinder 110, including first recess 210 and/or second recess 212, may be formed using different processes. In an exemplary embodiment, a CNC machine or similar apparatus may be used to cut or remove a portion of cylinder 110 to form the recesses at the desired locations, including the locations of first recess 210 and/or second recess 212. In other embodiments, recesses or depressions in outer surface 200 of cylinder 110 may be formed using other methods, including, but not limited to molding or casting techniques.

Figure 3:
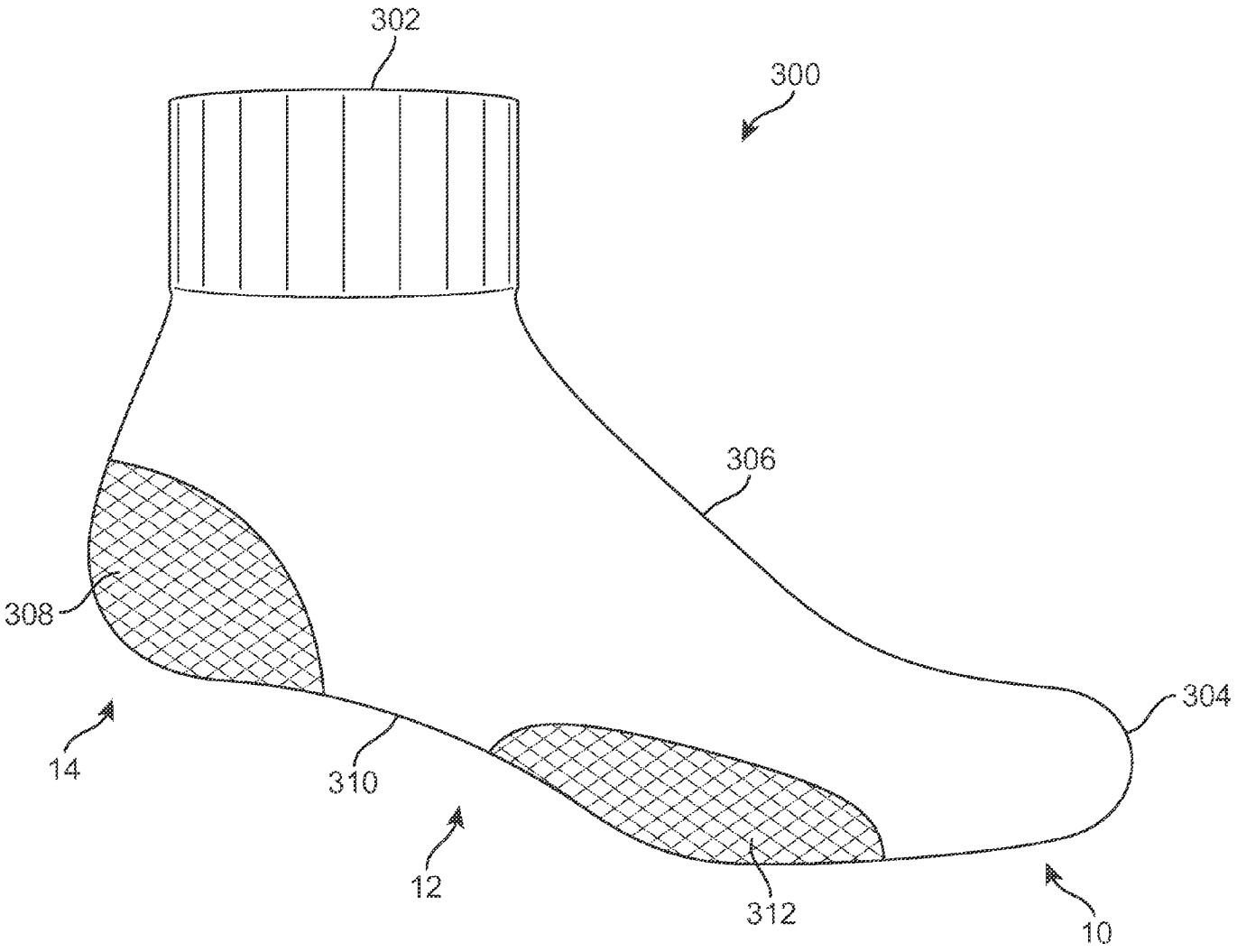
FIG. 3 is a schematic view of an exemplary embodiment of a tubular article.

Referring now to FIG. 3, an exemplary embodiment of a tubular article in the form of an athletic sock 300 is illustrated. In other embodiments, various other articles may be used in the present embodiments, including any of the articles described above. For purposes of reference, sock 300 may be divided into forefoot portion 10, midfoot portion 12, and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone.

In this embodiment, sock 300 may be a quarter-length sock. In other embodiments, sock 300 may be any type of sock, including a crew-length sock, an ankle sock, an overthe-calf length sock, as well as shorter or longer types of socks. In an exemplary embodiment, sock 300 may have a cuff end 302 that is associated with an opening in sock 300 for receiving a foot of a wearer. Opposite cuff end 302 is a toe end 304 that is associated with the toes of a wearer when a foot is disposed within sock 300. Sock 300 may also include a body 306 that is associated with the portion of sock 300 between cuff end 302 and toe end 304. In an exemplary embodiment, body 306 may be configured to cover an instep of a foot of a wearer of sock 300.

In some embodiments, a tubular article, including sock 300, may include one or more regions of varying thickness. In an exemplary embodiment, body 306 may be generally associated with a first thickness and one or more regions of sock 300 may have greater thickness than body 306. The regions of varying thickness may be disposed on different portions of an article. In this embodiment embodiment, sock 300 may include a first padded region 308. First padded region 308 may be a region of increased thickness disposed in heel portion 14 of sock 300. In one embodiment, first padded region 308 may be configured with a greater thickness than the first thickness associated with body 306 of sock 300 to provide comfort and/or cushioning to a heel of a wearer.

In some embodiments, sock 300 may include additional regions of increased thickness. In this embodiment, sock 300 may also include a second padded region 312. Second padded region 312 may be a region of increased thickness disposed generally in a portion of sock 300 that corresponds to the ball of a foot of a wearer in at least a portion of midfoot portion 12 and/or forefoot portion 10. In one embodiment, second padded region 312 may be configured with a greater thickness than the first thickness associated with body 306 of sock 300 to provide comfort and/or cushioning to the ball of a foot of a wearer. In some embodiments, first padded region 308 and second padded region 312 may have the same thickness that is greater than the first thickness associated with body 306. In other embodiments, first padded region 308 and second padded region 312 may have different thicknesses from each other.

In this embodiment, first padded region 308 and second padded region 312 may be separated from each other by an arch portion 310. In an exemplary embodiment, arch portion 310 may be a portion of sock 300 disposed along the bottom of midfoot portion 12. In one embodiment, arch portion 310 may be associated with substantially the same thickness as the first thickness associated with body 306, described above. In other embodiments, the locations of regions of varying thickness may be disposed on different regions of sock 300 than those illustrated in FIG. 3.

Figure 4:
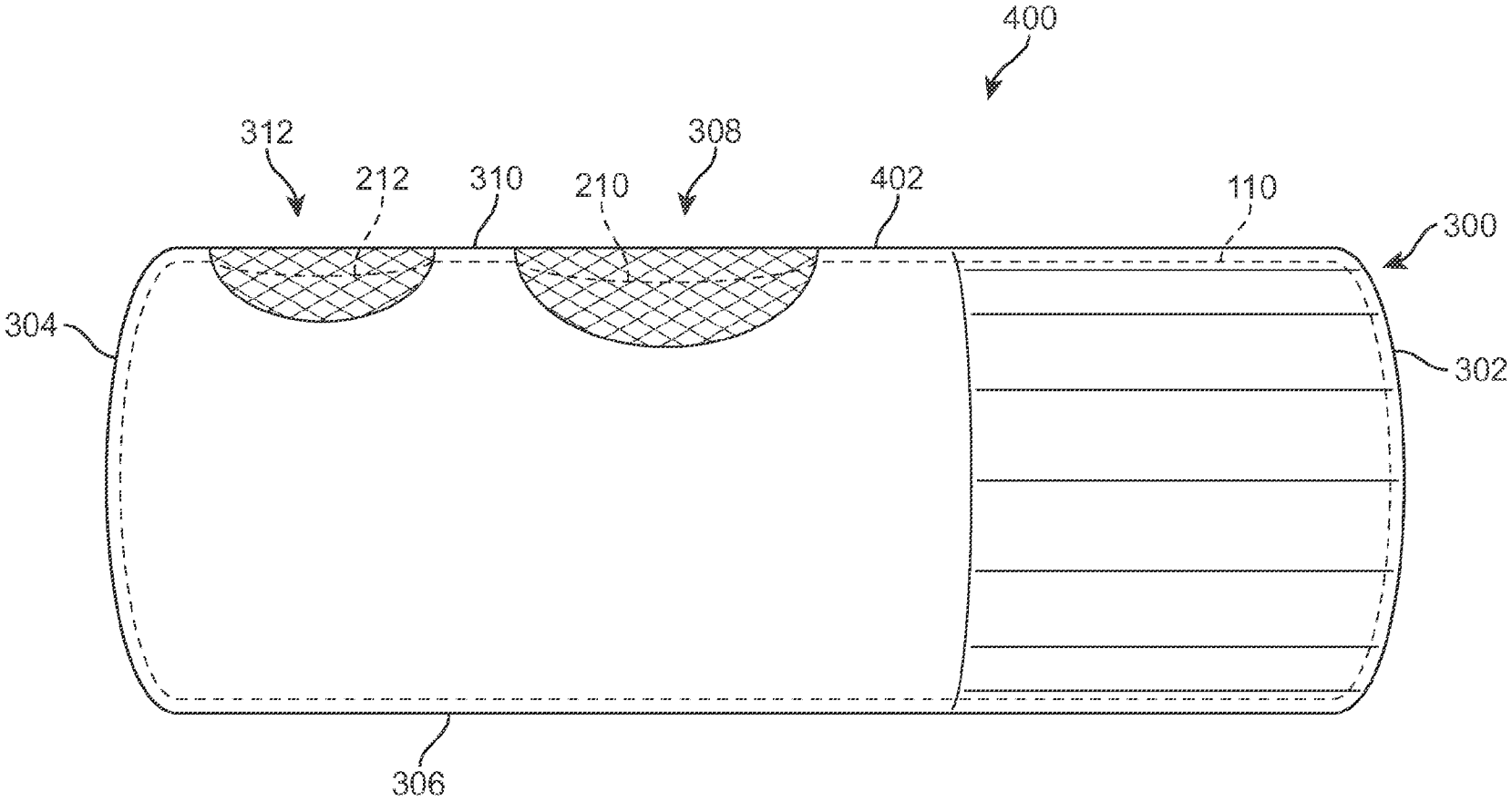
FIG. 4 is a representational view of a tubular article disposed around an exemplary embodiment of a cylinder for holding tubular articles.

Referring now to FIG. 4, a representational view of a mounted article 400 is illustrated. In this embodiment, mounted article 400 is provided by placing sock 300 onto cylinder 110. Cylinder 110 may be inserted through the opening at cuff end 302 of sock and sock 300 may be pulled tight over outer surface 200 of cylinder 110 to provide mounted article 400. Mounted article 400 may include a substantially uniform flat surface 402 that is configured for printing thereupon. In some embodiments, cylinder 110 may include recesses or depressions, as described above. In an exemplary embodiment, the recesses or depressions in outer surface 200 of cylinder 110 may be configured to correspond to the one or more regions of sock 300 that have a greater thickness than the first thickness associated with body 306 of sock 300.

As shown in FIG. 4, first recess 210 in outer surface 200 of cylinder 110 may be configured to correspond to the location of first padded region 308 of sock 300. Similarly, second recess 212 in outer surface 200 of cylinder 110 may be configured to correspond to the location of second padded region 312 of sock 300. In an exemplary embodiment, the size and shape of first recess 210 and/or second recess 212 on cylinder 110 may be configured to correspond to the size and shape of first padded region 308 and/or second padded region 312 of sock 300. With this arrangement, first recess 210 and/or second recess 212 can accommodate the regions of varying thickness of an article, including first padded region 308 and/or second padded region 312 of sock 300, to provide substantially uniform flat surface 402 for printing. In other embodiments where an article includes a larger or smaller number of regions of varying thickness, the outer surface of a cylinder may include a corresponding number, location and/or size of recesses or depressions.

Figure 5:
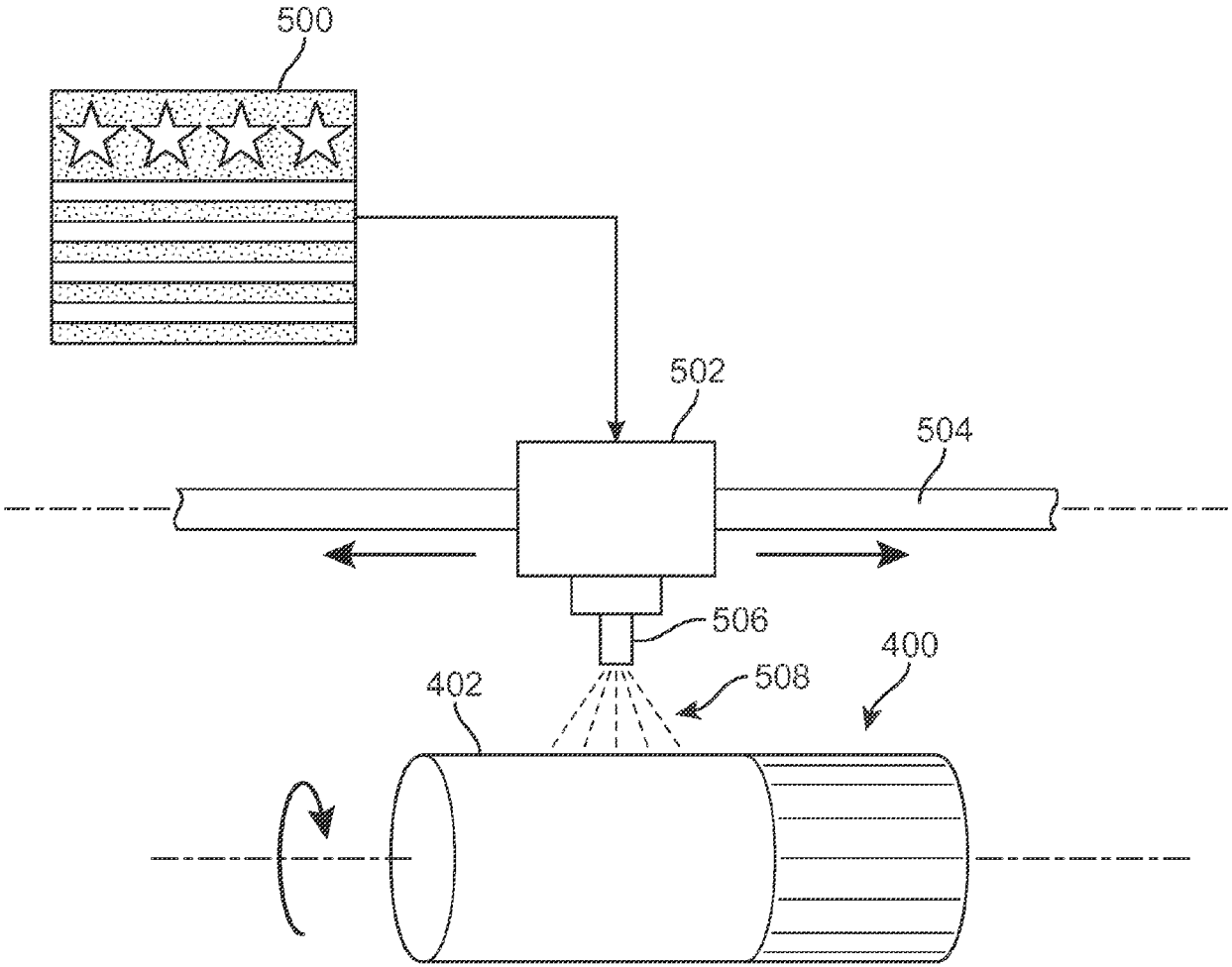
FIG. 5 is a schematic view of an exemplary embodiment of using a customization system including a cylinder for holding a tubular article for printing.
Figure 6:
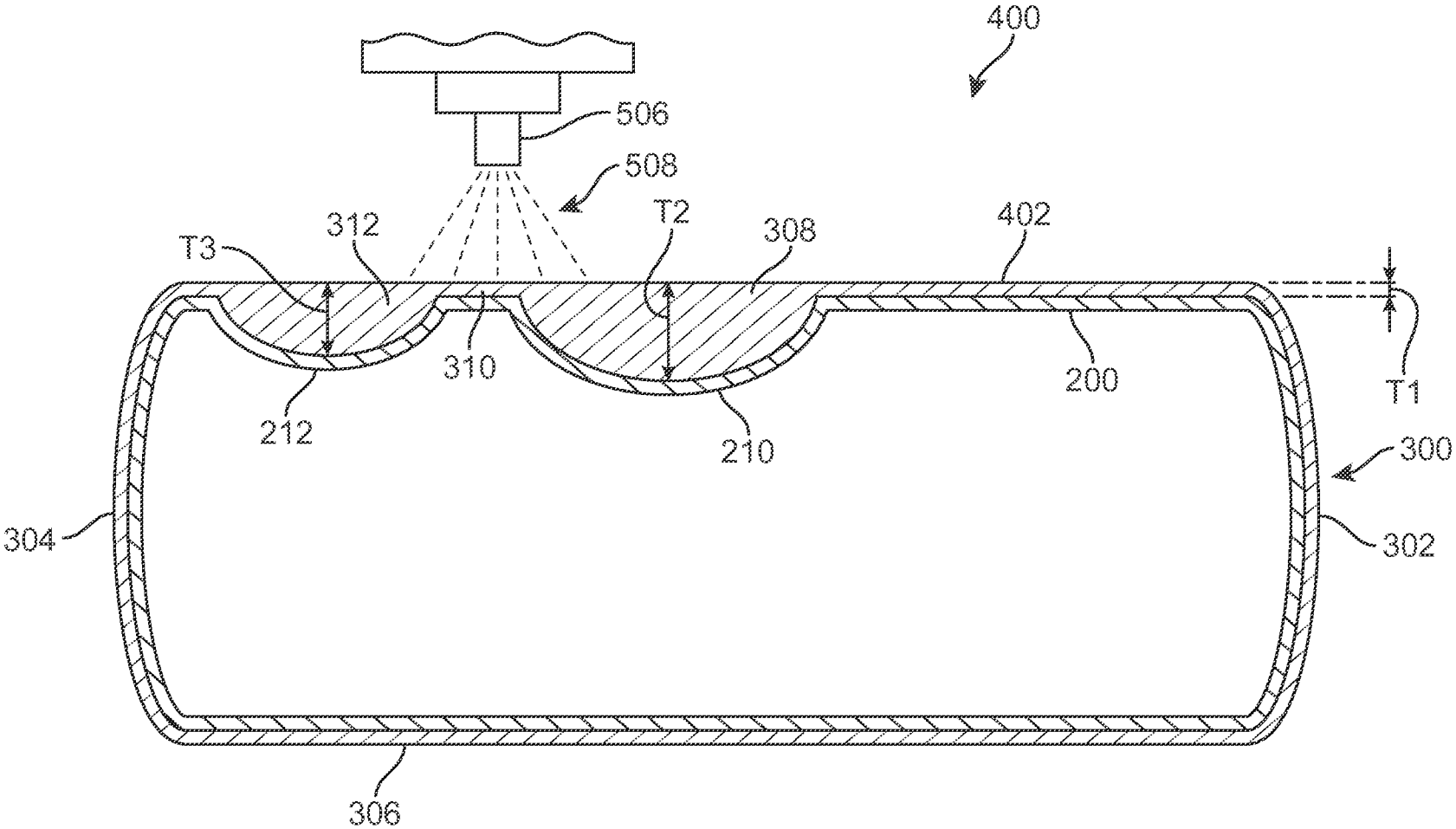
FIG. 6 is an enlarged cross-sectional view of an exemplary embodiment of printing onto a tubular article using a cylinder.

FIGS. 5 and 6 illustrate an exemplary embodiment of using a customization system including a cylinder for holding a tubular article for printing onto the article. Referring now to FIG. 5, a representational view of printing a graphic 500 onto mounted article 400 is illustrated. Graphic 500 could be stored using a computer system in communication with customization system 100 or may be retrieved from another source. In other embodiments, graphic 500 may be designed using software associated with customization system 100. In one embodiment, graphic 500 may be a custom designed image that may be applied to an article for the purposes of customizing the article to suit a particular customer or user. In some embodiments, customization system 100 may be used to print graphic 500 onto a tubular article. In this embodiment, sock 300 has been mounted onto cylinder 110 to provide mounted article 400 for printing graphic 500 thereupon.

As described above, in some embodiments, customization system 100 may include printing system 104 having a printer 502. In an exemplary embodiment, printer 502 may be mounted upon one or more rails 504 to allow printer 502 to move or translate along an x-axis aligned with the longitudinal direction of mounted article 400 on cylinder 110. In cases where printer 502 includes an inkjet printer, one or more printheads, including a printhead 506, may be configured to deposit ink droplets 508 onto a substrate. In this embodiment, printhead 506 is configured to spray ink droplets 508 onto substantially uniform flat surface 402 of mounted article 400. As described above, mounted article 400 may be configured to circumferentially rotate during printing so as to rotate mounted article 400 for printing.

In an exemplary embodiment, rotation of mounted article 400 and/or movement of printer 502 along rails 504 may allow graphic 500 to be printed onto substantially all of mounted article 400. In one embodiment, graphic 500 may be printed over mounted article 400 through approximately 360 degrees of rotation. In some cases, graphic 500 may be printed over mounted article 500 through slightly more than 360 degrees of rotation in order to provide a small overlap between the starting and end points of printing graphic 500 onto mounted article 400. With this arrangement, graphic 500 may be printed across the majority of the circumference of a tubular article. In other embodiments, more or less of mounted article 400 may be printed upon, including only a portion of mounted article 400 associated with less than 360 degrees of rotation. In still other embodiments, mounted article 400 may be rotated approximately 180 degrees or less to print upon only a portion of the circumference of a tubular article.

In addition, in other embodiments, multiple graphics of varying sizes, colors, and/or configurations may be printed on substantially all of mounted article 400 or on one or more portions of mounted article 400. In addition, in the present embodiment, printhead 506 may be located a fixed, predetermined distance from substantially uniform flat surface 402 of mounted article 400. In other embodiments, however, printhead 506 may be configured to move in a vertical direction relative to substantially uniform flat surface 402.

In some embodiments, the layout of graphic 500 may be processed by a computer or processor into a series of commands for moving printer 502 along rails 504 and/or rotating mounted article 400 to deposit ink droplets 508 onto the appropriate locations on substantially uniform flat surface 402 of mounted article 400 to generate graphic 500 onto mounted article 400. In an exemplary embodiment, a suitable computer system that may be used for preparing graphic 500 or other graphics for printing is disclosed in commonly owned U.S. Pat. No. 9,004,675 , to Miller et al., entitled "Image Correction with 3D Printing".

Referring now to FIG. 6, an enlarged cross-sectional view of an exemplary embodiment of printing onto a tubular article using a cylinder is illustrated. In this embodiment, mounted article 400 is shown in cross-section to illustrate the recesses or depressions in cylinder 110 that are configured to accommodate corresponding regions of increased thickness on sock 300.

As shown in this embodiment, sock 300 is disposed over outer surface 200 of cylinder 110. In one embodiment, sock 300 includes body 306 that is generally associated with a first thickness T1. As described above, sock 300 may further include one or more regions of increased thickness, including, but not limited to first padded region 308 and/or second padded region 312. In an exemplary embodiment, first padded region 308 may be associated with a second thickness T2. In some cases, second thickness T2 may be larger than first thickness T1 associated with body 306 of sock 300. Similarly, second padded region 312 may be associated with a third thickness T3. In some cases, third thickness T3 may be larger than first thickness T1 associated with body 306 of sock 300. In addition, in some cases, third thickness T3 may be larger than first thickness T1, but smaller than second thickness T2. In other cases, however, second thickness T2 and third thickness T3 may be substantially similar, or third thickness T3 may be larger than second thickness T2.

In an exemplary embodiment, outer surface 200 of cylinder 110 may include recesses or depressions corresponding to the regions of increased thickness on sock 300. In this embodiment, first recess 210 in outer surface 200 of cylinder 110 corresponds to the location of first padded region 308 of sock 300 and has a depth that corresponds to second thickness T2 of first padded region 308. Similarly, second recess 212 in outer surface 200 of cylinder 110 corresponds to the location of second padded region 312 of sock 300 and has a depth that corresponds to third thickness T3 of second padded region 312. In addition, as shown in FIG. 6, arch region 310 disposed between first padded region 308 and second padded region 312 is associated with first thickness T1 of the remaining portion of body 306 of sock 300.

In this embodiment, the recesses or depressions in outer surface 200 of cylinder 110 are configured to accommodate the regions of varying thickness on sock 300 to provide substantially uniform flat surface 402. With this arrangement, ink droplets 508 from printhead 506 may have a relatively flat and uniform substrate for applying a graphic thereupon. In addition, substantially uniform flat surface 402 may be kept at an approximately constant distance from printhead 506 to assist with uniform application of ink droplets 508. Accordingly, a printed graphic may be applied to an article without significant distortions or irregularities caused by regions of varying thickness on an article that may cause portions of the article to be located closer or farther from printhead 506, thereby causing inconsistent application of ink droplets 508.

Figure 7:
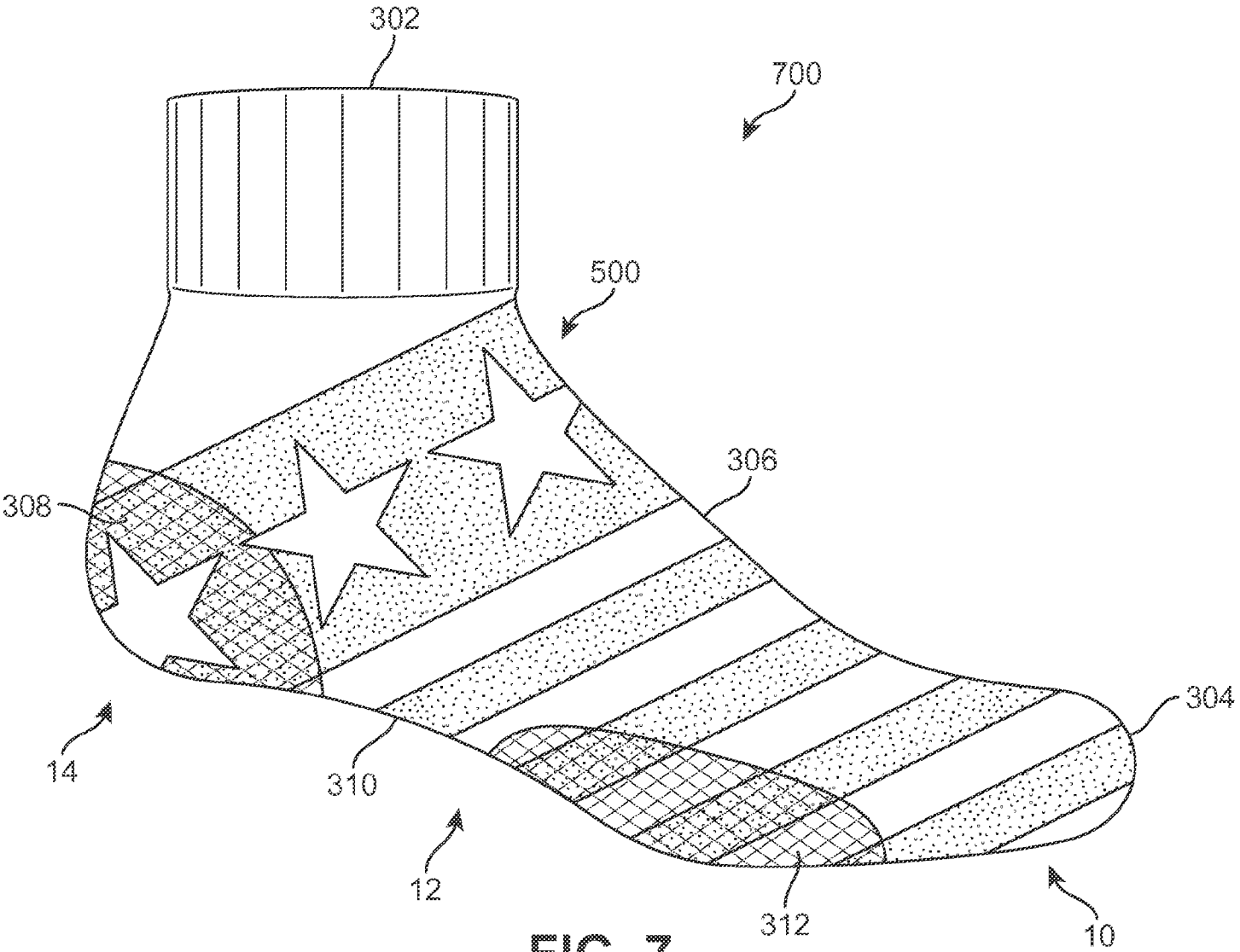
FIG. 7 is a schematic view of an exemplary embodiment of a tubular article having a graphic printed using a customization system including a cylinder.

FIG. 7 illustrates an exemplary embodiment of a printed tubular article 700 that has been printed using the system and process described herein. As shown in FIG. 7, printed tubular article 700 is sock 300 that has had graphic 500 printed thereupon using cylinder 110. After printing graphic 500 onto sock 300 using printing system 104, described above, sock 300 may be removed from cylinder 110 to result in printed tubular article 700. Graphic 500 may be printed across one or more portions of body 306, first padded region 308, arch region 310, and/or second padded region 312. By using cylinder 110 having recesses or depressions to accommodate the regions of varying thickness on sock 300 to provide a substantially uniform flat surface, graphic 500 may have an approximately even appearance across printed tubular article 700, including portions of graphic 500 that cross over regions of increased thickness, for example first padded region 308 and/or second padded region 312.

It should be understood that while in the previous embodiments, an exemplary tubular article of apparel in the form of a single sock has been illustrated, the principles described herein may be similarly applied to a second identical tubular article to provide a pair of socks, or other similar tubular articles that are worn as pairs.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims. Further, any element of any embodiment may be used in any other embodiment or substituted for another element of another embodiment unless specifically restricted.

What is claimed is:

1. A customization system for printing a graphic onto a tubular article of apparel, comprising:

a printing system, including a printer, a printhead and a platform;

a first roller and a second roller positioned on the platform;

a cylinder for holding the tubular article in proximity to the printer;

wherein the tubular article is disposed over an outer surface of the cylinder;

wherein the cylinder is disposed on top of the first roller and the second roller;

wherein the first roller and the second roller rotate on the platform when the printer moves along tracks;

wherein the rotation of the first roller and the second roller cause the cylinder to rotate; and wherein the cylinder is configured to rotate relative to the printer to allow the printer to print a graphic onto the tubular article.

2. The customization system according to claim 1, further comprising at least one recess in the outer surface of the cylinder; and wherein the at least one recess corresponds to a region of increased thickness disposed on the tubular article.

3. The customization system according to claim 2, wherein a depth of the at least one recess is equal to a thickness of the region of increased thickness disposed on the tubular article.

4. The customization system according to claim 3, wherein the region of increased thickness on the tubular article disposed within the at least one recess and the remaining portion of the tubular article disposed over the outer surface of the cylinder comprise a substantially uniform flat surface.

5. The customization system according to claim 4, wherein the graphic is applied to the substantially uniform flat surface of the tubular article.

6. The customization system according to claim 1, wherein the tubular article disposed over the cylinder includes a substantially uniform flat surface.

7. The customization system according to claim 6, wherein the graphic is applied to the substantially uniform flat surface of the tubular article.

8. A system for printing a graphic onto a tubular article of apparel, comprising:

a cylinder for holding the tubular article of apparel to assist with printing the graphic onto the tubular article, wherein the cylinder includes an outer surface of the cylinder, the outer surface having a length along a longitudinal direction of the cylinder and the cylinder having a diameter;

the length and the diameter of the cylinder sized and dimensioned so as to correspond to a length and diameter of the tubular article of apparel;

a printer for printing the graphic onto the tubular article of apparel;

a platform positioned under the printer;

a pair of rollers in contact with the platform;

wherein the cylinder is positioned on to of the pair of rollers;

wherein the cylinder is configured to rotate when the pair of rollers rotate along the platform to expose an exterior surface of the tubular article to the printer for printing; and wherein the printer including a printhead configured to move along the longitudinal direction of the cylinder.

9. The system according to claim 8, wherein the tubular article is disposed over the outer surface of the cylinder.

10. The system according to claim 9, further comprising at least one recess in the outer surface of the cylinder; and wherein the at least one recess corresponds to a region of increased thickness disposed on the tubular article.

11. The system according to claim 10, wherein a depth of the at least one recess is equal to a thickness of the region of increased thickness disposed on the tubular article.

12. The system according to claim 8, wherein the printer is configured to apply the graphic to the tubular article throughout at least 180 degrees of rotation of the cylinder.

13. The system according to claim 12, wherein the graphic is applied throughout at least 360 degrees of rotation of the cylinder.

14. The system according to claim 13, wherein the graphic is applied through more than 360 degrees of rotation of the cylinder, such that at least a portion of the graphic overlaps.

15. A system for printing a graphic onto a tubular article of apparel, comprising:

a cylinder for holding the tubular article of apparel to assist with printing the graphic onto the tubular article, wherein the cylinder includes a diameter associated with the cylinder and a length along a longitudinal direction of the cylinder;

an outer surface disposed over the length of the cylinder;

the outer surface including at least one recess, the at least one recess extending a depth below the outer surface;

wherein the tubular article of apparel is configured to be disposed over the outer surface of the cylinder;

wherein at least one region of increased thickness disposed on the tubular article is configured to correspond with the at least one recess disposed in the outer surface of the cylinder;

wherein the cylinder is disposed on top of rollers, wherein the rollers are positioned along a platform and the rollers rotate on the platform; and the rollers are configured to rotate the cylinder to expose the tubular article for printing the graphic.

16. The system according to claim 15, wherein a depth of the at least one recess is equal to a thickness of the at least one region of increased thickness disposed on the tubular article.

17. The system according to claim 15, wherein the at least one region of increased thickness on the tubular article disposed within the at least one recess and the remaining portion of the tubular article disposed over the outer surface of the cylinder comprise a substantially uniform flat surface.

18. The system according to claim 17, wherein the graphic is configured to be printed onto the substantially uniform flat surface of the tubular article, including onto at least a portion of the at least one region of increased thickness.

19. The system according to claim 15, further comprising:

a second recess disposed in the outer surface of the cylinder, the at least one recess being spaced apart from the second recess;

wherein the tubular article includes a second region of increased thickness;

wherein the at least one recess is configured to correspond to the at least one region of increased thickness when the tubular article is disposed over the cylinder; and wherein the second recess is configured to correspond to the second region of increased thickness when the tubular article is disposed over the cylinder.

20. The system according to claim 19, wherein the tubular article further comprises a body having a first thickness; and wherein the at least one region of the tubular article is associated with a second thickness, the second thickness being larger than the first thickness; and wherein the second region of the tubular article is associated with a third thickness, the third thickness being larger than the first thickness.

* * * * *